United States Patent [19]

Dufresne et al.

[11] Patent Number: 4,749,464

[45] Date of Patent: Jun. 7, 1988

[54] NON CONDUCTIVE EDGE STRIP FOR USE ON AN ELECTROLYTIC METAL REFINING CATHODE

[75] Inventors: Jean L. Dufresne; Robert P. Dufresne, both of St-Bruno, Canada

[73] Assignee: Technical Plastic T-R Ltd., Quebec, Canada

[21] Appl. No.: 856,233

[22] Filed: Apr. 28, 1986

[51] Int. Cl.[4] ..... C25C 7/02

[52] U.S. Cl. ..... 204/286; 204/105 R; 204/106; 204/279; 264/136; 425/112; 428/122; 428/290; 428/358

[58] Field of Search ..... 204/105 R, 106, 279, 204/286; 264/136; 425/112; 428/122, 290, 358

[56] References Cited

U.S. PATENT DOCUMENTS

| | | | |
|---|---|---|---|
| 2,048,854 | 7/1936 | Dyer | 204/286 |
| 3,530,047 | 9/1970 | Billett | 204/286 |
| 4,186,074 | 1/1980 | Perry | 204/286 |
| 4,194,873 | 3/1980 | Killmeyer | 425/112 |
| 4,289,465 | 9/1981 | Killmeyer et al. | 425/112 |
| 4,319,970 | 3/1982 | Schatton et al. | 204/286 |
| 4,447,307 | 5/1984 | Davis et al. | 204/286 |
| 4,564,540 | 1/1986 | Davies et al. | 428/358 |

FOREIGN PATENT DOCUMENTS

| | | | |
|---|---|---|---|
| 143635 | 9/1980 | Fed. Rep. of Germany | 204/286 |
| 2081638 | 2/1982 | United Kingdom | 264/136 |
| 584058 | 12/1977 | U.S.S.R. | 204/286 |

*Primary Examiner*—John F. Niebling
*Assistant Examiner*—Kathryn Rubino
*Attorney, Agent, or Firm*—Robic, Robic & Associates

[57] ABSTRACT

A non conductive, edge-strip for use on an electrolytic metal refining anode or cathode to prevent metal deposit problems over the edge contours of this cathode. The edge-strip is in the shape of an elongated profile member with a U-shaped cross-section sized to extend over, and fit snuggly onto an edge of the cathode. The edge-strip is made by pultrusion of fiberglass impregnated with a polymeric resin resistant to acids and alkalis, and externally covered with a surfacing veil resistant to acids and electrochemical attacks.

5 Claims, No Drawings

NON CONDUCTIVE EDGE STRIP FOR USE ON AN ELECTROLYTIC METAL REFINING CATHODE

The present invention relates to an improved, non conductive edge-strip for use on an electrolytic metal refining electrode such an electrolyte refining cathode or an anode, and to an electrode provided with such an improved edge strip.

As is well known, the conventional process used for the electrolytic refining of metal such as copper, basically consists in placing anodes made of metal to be refined, such as unpurified Cu, Zn, Ni or Co, in an electrolytic cell containing a concentrated solution of hydrochloric and sulphuric acids (20%). Then, this sheets of pure metal acting as <<starters>> are suspended between the anodes and used as cathodes. With the passage of an electrical current from the anodes through the electrolyte to the cathodes, the metal dissolves from the anodes and is deposited generally more than 99.9% pure on the cathodes. On the other hand, the impurities settle to the bottom of the cell where they can be recovered. The purified metal deposited on the cathode may, of course, be removed from the tank and melted down in bars or blocks for further processing.

This electrolytic process is very efficient but well known for creating metal deposits over the edge contours of the cathodes. In order to solve this well known problem, it has been suggested in U.S. Pat. No. 4,186,074 issued on Jan. 29, 1980 in the name of Copper Refinery PTY Ltd., to use <<masks>> on at least the side edges of the starter sheets. These masks basically comprise a longitudinally slotted, plastic beading held on the sheet by means of plastic pins extending through holes formed in the sheet. The beadings and the pins are preferably made of the same plastic material, preferably a polymeric alloy of acrinolic, butadiene and styrene (ABS) and polycarbonate; which alloy is known as CYCOLOY 800.

The solution suggested in this patent to overcome the prior art problem is rather interesting but has some drawbacks too. First of all, the plastic edge-strips used as masks are not very resistant to impacts and must be frequently changed. Secondly, they must be secured to the cathode plates by means of pins or similar positive fixation, thereby leading to substantial installation and maintenance costs. Moreover, it appears that, in use, the electric current passes through underneath the plastic edge-strips and attract thereto the metal ions. These attracted ions produce undesired nodules of unpurified metal and form <<metal build-ups>> which, due to their formation, contain a substantial amount of metal impurities.

An object of the present invention is to provide an improved, non conductive edge-strip for use on an electrolytic metal refining electrode, which edge-strip is strong and tight enough to avoid the above mentioned problem referred to hereinabove.

Another object of the invention is to provide an electrode with such an improved edge strip for use in an electrolytic cell.

The non conductive edge-strip according to the invention is intended to be used on an electrolytic metal refining cathode or anode. It is in the shape of an elongated profile member with a U-shaped cross-section sized to extend over, and fixedly onto an edge of the electrode.

In accordance with the invention, the edge-strip is made by pultrusion of fiberglass impregnated with at least one polymeric resin selected from the group consisting of vinylester resins, polyester resins, polybutadiene resins and epoxy resins resistant to acids and alkalis, and externally covered with the surfacing veil resistant to acids and electrochemical attacks.

The pultrusion process used for manufacturing the edge-strip according to the invention is a well known process which is typically used in the industry for the manufacture of reinforced fishing rods, ladders, I-beams, electrical pole-line hardware, tool handles and the like. In this process, fiberglass in the form of continuous filaments or continuous mats, is passed into a bath of resin preferably kept at a low viscosity to ensure rapid saturation of the fiber bundles. After removal of the excess resin which is returned to the bath, the impregnated fiberglass is passed successively through a preforming die and then through a heated steel die wherein the resin impregnating the fiberglass is cured. Passage of the fiberglass from its storing spools to the impregnation bath and from this bath through the dies is obtained by means of high power pulling rollers mounted behind the dies. If desired, a shearing device may be used behind the pulling rollers to cut the pultruded product at any desired length.

It should be noted that the selection of the resin is rather important since it determines the weather resistance, the thermal resistance, the burning characteristics, the moisture sensitivity, the chemical resistance and most of the electrical properties of the pultrused product.

In accordance with a preferred embodiment of the invention, the non conductive edge-strip is advantageously made from 40 to 70% by weight of fiberglass, from 30 to 60% by weight of polyester-resin and from 1 to 2% by weight of surfacing veil. Advantageously, one part of the fiberglass subjected to pultrusion is in the form of filaments, the remaining part being in the form of a mat. The use of such a mat is rather interesting since it contains transversal fibers which substantially improve the transversal resistance of the pultruded edge-strip.

As can be easily understood, the polyester, vinylesters or polybutadiene or epoxy resins used for the manufacture of the edge strips according to the invention must be non corrosive and resistant to acids or alkalis. Advantageously, use can be made of the vinylester resin sold by Dow Chemicals under the tradename DERAKANE 411/45.

The surfacing veil used in accordance with the invention for externally covering the impregnated fiberglass, must of course be also resistant to acids and electrochemical attacks. Advantageously, use can be made of the surfacing veil made of polyester fibers and sold by Burlington Glass Fabric Co. under the tradename NEXUS. External covering of the impregnated fiberglass with the surfacing veil is made during the pultrusion process, just before the impregnated fibers are pulled through the preforming and heating dies. In other words, the surfacing veil is shaped and pulled through both dies simultaneously with impregnated fiberglass.

In accordance with the invention, there is also provided an electrolytic metal refining electrode comprising:

a <<starter>> metal plate provided with upper, lateral and lower edges;

means preferably consisting of hooks, for vertically suspending the metal plate to a suspension bar extending across an electrolytic cell; and a pair of non conductive edge-strips as defined hereinabove, these edges strips extending over and fitting snuggly onto the lateral edges of the metal plate.

Advantageously, the electrode may comprise an additional edge-strip as defined hereinabove, extending over and fitting snuggly onto the lower edge of the metal plate.

When the electrode is a cathode, it can be made of pure metal or, alternatively, of plastic material containing a sufficient amount of conductive fillers to make it conductive. In the latter case, the non conductive edge-strips can be made integral to the cathode plate, or they can be attached thereto.

In practise, the non conductive edge-strips may be directly pultruded over the lateral edges of the cathodes by placing the same behind the pulling rollers of a pair of parallel pultrusion machines. Alternatively, the edge-strips may be cut at the desired length and added whenever necessary or wanted to the edges of the metal plate. Such an addition may of course be carried out directly onto the premises.

The edge-strip according to the invention has a major advantage in that it is much more resistant to impacts than the edge-strips made of PVC or polypropylene. This higher resistance can be explained by the use of fiberglass which substantially reinforces the edge-strip structure.

The edge-strip according to the invention also has the substantial advantage of snuggly fitting in a very tight manner onto the edges of a refining cathode, thereby making it unnecessary to use fixation pins in addition to preventing electrolyte infiltration and thus the production of undesired nodules of unpurified metal under the strips; the nodules affect the whole refining process when they are remelted with the cathodes after the electrolytic refining has been completed. Such a snug fitting can also be explained by the use of fiberglass which gives a string resiliency to the edge-strip structure, and by the way the edge-strip is manufactured.

Last of all, the edge-strip according to the invention has the advantage of lasting longer than the PVC edge-strip, essentially because of their enhanced chemical resistance, dielectrical resistance and resistance to impacts due to the fiberglass and thermosetting resin.

EXAMPLE

Using a standard pultrusion machine, a length of a non conductive edge-strips in the shape of an elongated profile member having a U-shaped cross-section, was manufactured. The distance between the arm of the U-shaped profile member was selected so that this profile member may extend over and fit snuggly onto a standard electrolytic copper refining cathode. To improve the tight fixation of the profile member onto the edge of the cathode, the U-shaped profile was pultruded in such a manner that its arms slope inwardly toward each other from the bottom up to the top of the profile.

The specification of the so pultruded edge-strip were as follows:

| | |
|---|---|
| Length: | from 1 to 2 meters |
| Height: | 2 cm |
| External width (at the bottom): | 1.5 cm |
| Internal width of the central groove (at the bottom of the profile): | 5 mm |
| Internal width of the groove between the arms on top of the profile member: | 2 mm |
| Thickness of the wall of the profile arms: | 4 mm |

This non conductive edge-strip was made by pultrusion of 60% by weight of fiberglass impregnated with 38.5% by weight of DERAKANE 411/45 and externally covered with 1.5% by weight of NEXUS style 11-110 surfacing veil.

The pultruded fiberglass consisted of about 40% by weight of filaments and 60% by weight of fiberglass mat.

Test conducted with such edge-strips have shown that they were easy to install rigidly and tightly onto the edges of a copper refining cathode.

In use, they led to a substantially reduced amount of undesired modules of unpurified metal due to their tightness, and they lasted between 10 to 20% longer than similar plastic edge-strips due to their high resistance to impact during manipulation of the cathodes.

What is claimed is:

1. An electrolytic metal refining electrode comprising:

a conductive plate provided with lateral and lower edges;

means for vertically suspending said conductive plate to a suspension bar; and a pair of non conductive edge-strips extending over and fitting snuggly onto said lateral edges of said conductive plate, wherein each of said non conductive edge-strips is in the shape of an elongated profile member with a U-shaped cross-section sized to extend over and fit snuggly onto edge of the plate, said edge strip being made by pultrusion of fiberglass impregnated with at leats one polymeric resin selected from the group consisting of vinyl ester resins, polyester-resins, polybutadiene resins and epoxy resins resistant to acids and alkalis, and externally covered with a surfacing veil resistant to acid and electrochemical attacks;

said edge strip comprising from 40% to 70% by weight of fiberglass; from 30% to 60% by weight of polymeric resin; and from 1 to 2% by weight of surfacing veil, one part of the fiberglass subjected to pultrusion being in the form of filaments, and the remaining part in the form of a mat.

2. The electrode of claim 1, further comprising:

a further edge-strip identical in structure to those extending over and fitting snuggly on the lateral edges of the conductive plate, said further edge-strip extending over and fitting snuggly onto the lower edge of said metal plate.

3. The electrode of claim 1, when used as a cathode.

4. The electrode of claim 1, wherein the conductive plate is made of metal.

5. The electrode of claim 1, wherein the conductive plate is made of plastic material containing a sufficient amount of conductive fillers to make it conductive.

* * * * *